US005727468A

United States Patent [19]

Blackwell

[11] Patent Number: 5,727,468

[45] Date of Patent: Mar. 17, 1998

[54] DUCTOR BLADE FOR AN OFFSET ROTARY PRINTING PRESS

[75] Inventor: Joseph Gordon Blackwell, Brenouille, France

[73] Assignees: Heidelberger Druckmaschinen AG, Heidelberg, Germany; Heidelberg Harris S.A., Montataire Cedex, France

[21] Appl. No.: 643,602

[22] Filed: May 6, 1996

[30] Foreign Application Priority Data

May 5, 1995 [FR] France ..... 95 05396

[51] Int. Cl.[6] ..... B41F 31/02

[52] U.S. Cl. ..... 101/365; 101/363

[58] Field of Search ..... 101/169, 363, 101/366, 365

[56] References Cited

U.S. PATENT DOCUMENTS

| | | | |
|---|---|---|---|
| 3,611,841 | 10/1971 | Froden et al. | 76/101 R |
| 4,007,682 | 2/1977 | Gundlach | 101/348 |
| 4,287,828 | 9/1981 | Dahlgren | 101/363 |
| 4,407,196 | 10/1983 | Matalia et al. | 101/142 |
| 4,566,938 | 1/1986 | Jenkins et al. | 156/643 |
| 4,798,138 | 1/1989 | Brodie | 101/365 |
| 4,841,857 | 6/1989 | Hashimura et al. | 101/158 |
| 5,218,905 | 6/1993 | Bolte et al. | 101/348 |

*Primary Examiner*—Edgar S. Burr
*Assistant Examiner*—Dave A. Ghatt
*Attorney, Agent, or Firm*—Herbert L. Lerner; Laurence A. Greenberg

[57] ABSTRACT

Doctor blade for an offset rotary printing press having an inking unit with an ink duct wherein the doctor blade is provided for, respectively, scraping ink from an ink duct roller and zonally metering an ink film layer thereon over the width of a web of printing material includes a ceramic coating disposed on an edge portion of the blade at a region thereof at which the ink duct roller is in contact therewith.

12 Claims, 2 Drawing Sheets

DUCTOR BLADE FOR AN OFFSET ROTARY PRINTING PRESS

BACKGROUND OF THE INVENTION

1. Field of the Invention

The invention relates to a ductor blade for an offset rotary printing press having an inking unit with an ink duct wherein the ductor blade is provided for, respectively, scraping ink from an ink duct roller and zonally metering an ink film layer thereon over the width of a web of printing material.

Ductor blades of this general type have become known heretofore. The ink duct or fountain of an offset rotary printing press is constructed so as to make a very thin film of ink available for printing. For this purpose, a multiplicity of rollers are provided to give the ink coming in a film or layer from the ink duct a uniform or even thickness zonally over the width of the web, the ink-layer thickness reducing from roller to roller. The aforementioned ductor blade, which bears against a roller of the ink duct, promotes this process by establishing a contact region on the surface of this roller whereon a consequently thin ink film forms. Excess ink is removed by the blade.

A result of the foregoing is that at the time of assembly of the printing press, the ductor blade has to be suitably oriented or aligned with the ink duct roller so that a thin and uniform film of ink is formed zonally over the width of the web. It is therefore necessary to adjust zonally over the width of the web, the position at which the ductor blade engages or bears down on the ink duct roller. A prerequisite therefore is not only that installation should be performed correctly, but that the edge of the ductor blade cooperating with the ink duct roller must match the contour of the latter, mainly that it must be rectilinear. During operation, rapid wear and corrosion of the edge of the ductor blade which cooperates with the ink duct roller is a disadvantage because this affects the printing results and requires subsequent adjustment work.

SUMMARY OF THE INVENTION

It is accordingly an object of the invention to provide a ductor blade for an offset rotary printing press which affords high reproducibility throughout a lengthy service life, i.e., throughout a long period of operation.

With the foregoing and other objects in view, there is provided, in accordance with the invention, a ductor blade for an offset rotary printing press having an inking unit with an ink duct wherein the ductor blade is provided for, respectively, scraping ink from an ink duct roller and zonally metering an ink film layer thereon over the width of a web of printing material, comprising a ceramic coating disposed on an edge portion of the blade at a region thereof at which the ink duct roller is in contact therewith.

In accordance with another feature of the invention, the ceramic coating contains titanium dioxide ($TiO_2$).

In accordance with a further feature of the invention, the ceramic coating contains alumina (Al2O3).

In accordance with an added feature of the invention, the ceramic coating comprises a mixture of alumina (Al2O3) and a small percentage of titanium dioxide (TiO2).

In accordance with an additional feature of the invention, the ceramic coating has a bending flexibility.

In accordance with yet another feature of the invention, the ceramic coating is a plasma-spray deposit.

In accordance with yet a further feature of the invention, the ceramic coating is deposited on a nickel/chromium layer.

In accordance with yet an added feature of the invention, the contact region forms an angle a of 3° to 15° with a tangent to the inking roller passing through a line of contact.

In accordance with yet an additional feature of the invention, the contact region is shaped as a chamfer of a free end of the blade.

In accordance with still another feature of the invention, the blade is formed with lateral edges converging towards a free end of the blade.

In accordance with still a further feature of the invention, the blade extends over almost the entire length of an ink plate of the ink duct roller.

In accordance with still an added feature of the invention, the blade has a base body formed of steel.

In accordance with still an additional feature of the invention, the blade has a base body formed of quenched steel.

In accordance with another feature of the invention, the steel is a subsequently tempered steel.

In accordance with a further feature of the invention, the steel base body has two unmachined faces to which the ceramic coating is applied.

In accordance with a concomitant feature of the invention, the blade is installable for operation exclusive of any processing of the ceramic coating to simulate deformations arising from a load exerted by adjusting elements acting thereon.

Thus, an essential feature of the invention is that the region at which the blade contacts the ink duct roller is provided with a ceramic coating. The contact region is particularly a line of contact between the blade and the ink duct roller, and the expression "line of contact" signifies that, in the contact region or regions, the blade bears slightly against the ink duct roller. The ceramic coating ensures that, on the one hand, a uniform surface matched to the contour of the ink duct roller is available and, on the other hand, it prevents wear. The very hard ceramic coating affords a long service life or operating period without any readjustment work having to be necessary. The reproducibility of the result of the work is thus optimized.

According to another particular feature of the invention, provision is made for the coating to contain titanium dioxide (TiO2). It is, moreover, advantageous for the coating to contain alumina (Al2O3). In particular, provision is made for the coating to contain a mixture of aluminum oxide (Al2O3) and a small percentage of titanium dioxide (TiO2).

The ceramic coating of the blade, in accordance with the invention, exhibits qualities of flexibility in bending, the maximum radius of curvature of the respective bend being preferably less than 20 cm.

A specific quality of the coating is advantageously obtained by depositing the coating by plasma spraying. A coating is advantageously deposited on an intermediate nickel/chromium alloy layer, promoting the properties of flexibility in bending, as well as protecting against corrosion. This layer has to be deposited first of all on the base body of the blade which is preferably formed of steel. The ceramic coating is then deposited on this intermediate layer.

The surface of the coating preferably faces the ink duct roller, i.e., this surface is parallel, as viewed in transverse section, to the tangent to the ink duct roller whereon the moving point of contact i.e., the line of contact, lies or, in other words, it coincides with this tangent. A slight deviation from this parallelism is, however, provided for, preferably within a small angular range which is approximately between 3° and 15°.

According to another advantageous feature of the invention, the contact region is shaped as a chamfer of the free end of the blade. The lateral edges of the blade advantageously converge towards the free end so as to prevent the ceramic coating, which is very sensitive to impact in the vicinity of the lateral edges of the ink duct, from coming into contact with the side walls of the latter, which may sometimes arise, for example, during assembly, adjustment work or also during service or operation. Overall, the blade thus exhibits quite approximately the contour of a trapezium.

The blade preferably comprises a base body which is, in particular, made of steel sheet or steel strip. This steel base body is preferably quenched and, in particular, is then tempered. This makes it possible to attain a predetermined mechanical strength for the base body. The two faces of the steel sheet or strip undergo no machining, apart from the preparation of the surface which is to take the coating. The result of depositing a ceramic coating is that it is not necessary to grind the coating to simulate the deformations arising from the load exerted by the application of the adjusting elements acting on the blade.

Other features which are considered as characteristic for the invention are set forth in the appended claims.

Although the invention is illustrated and described herein as embodied in a ductor blade for an offset rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
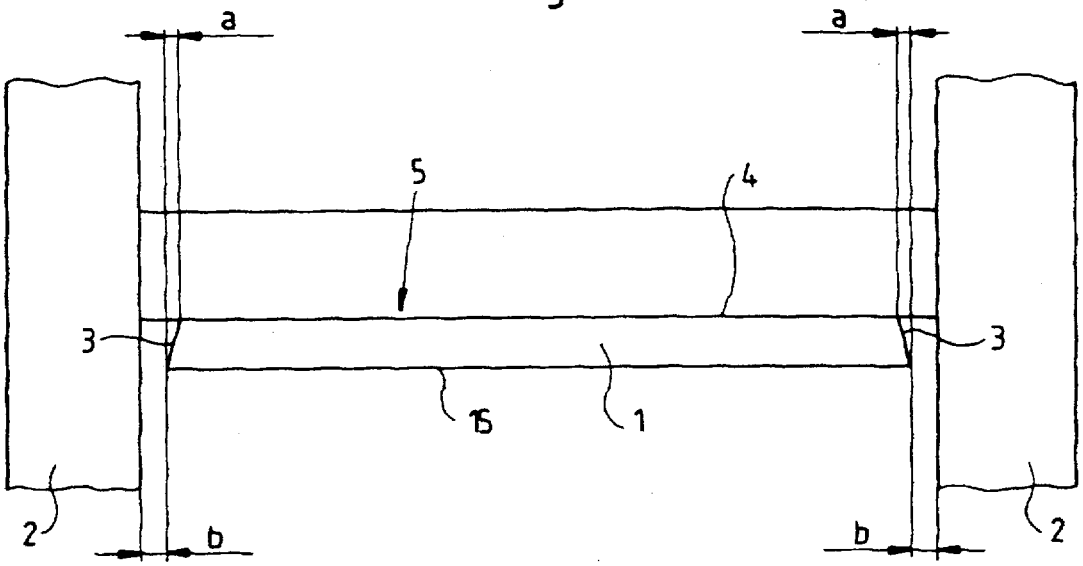
FIG. 1 is a diagrammatic top plan view of an ink ductor blade of an ink duct in an inking unit of an offset rotary printing press.
Figure 2:
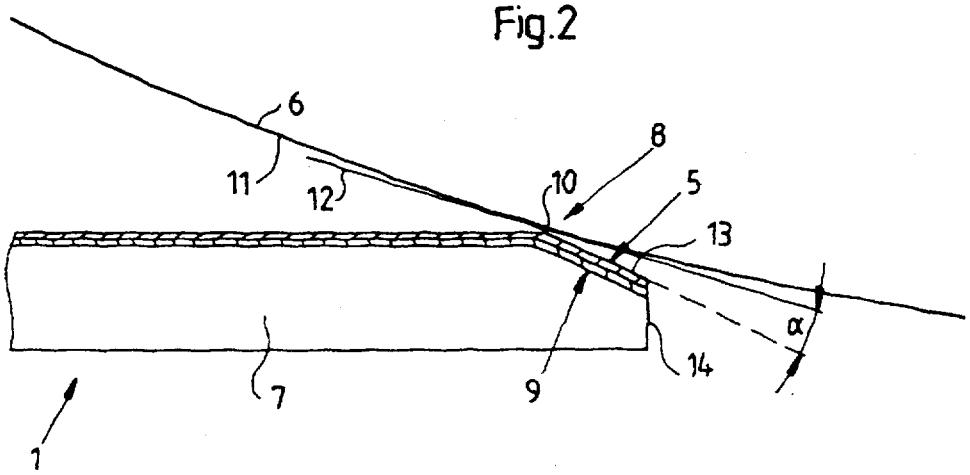
FIG. 2 is an enlarged diagrammatic side elevational view, partly in section, of a free end of the ductor blade of FIG. 1 cooperating with an ink duct roller.

Referring now to the drawing and, first, particularly to FIG. 1 and 2 thereof, there is shown therein diagrammatically a blade 1 which is situated in an ink duct which, but for the side walls 2 thereof, is otherwise not illustrated in the drawings. The blade 1 has a trapezoidal shape, i.e., has lateral edges 3 thereof converging towards a free end 4. This free end 4 has a ceramic coating 5 which cooperates with an ink duct roller 6 of an offset rotary printing press, which is otherwise not illustrated in the figures. This is readily apparent from FIG. 2.

The blade extends more-or-less over the entire length of the distributor or oscillator roller, for example, of the ink duct.

Each lateral edge 3 of the ductor blade 1 has a clearance between the rear edge 15 and the free edge 4 thereof which is advantageously 0.01 to 0.02 mm. The distance between the free edge 4 and each side wall 2 is advantageously from 0.01 to 0.02 mm. The magnitude of the clearance of the lateral edges 3 is identified by the reference character a in FIG. 1. The distance between the rear edge 15 and the respective side walls 2 is indicated by reference character b. The lateral edges 3 are preferably cut by a water jet during the manufacture of the blade 1.

The ductor blade 1 has a base body 7 formed of steel. The base body 7 is provided with a layer 9 of nickel/chromium alloy, at least in a contact region 8, i.e., on the side at which the ink duct roller 6 is located. This means that a layer of nickel/chromium alloy is deposited on the steel base body; preferably the latter being quenched and then tempered. A ceramic coating 5 which is deposited, preferably by plasma spraying, on this layer 9 of nickel/chromium alloy contains a mixture of alumina or aluminum oxide ($Al_2O_3$) and a few per cent of titanium dioxide ($TiO_2$).

As the side elevational view of FIG. 2 shows, a tangent 12 to the covering 11 of the ink duct roller 6, at the point of contact 10 of the ceramic coating 5 with the ink duct roller 6 forms an angle a to the surface 13 of this coating. This angle a widens from the point of contact 10 towards the end 14 of the blade 1. The angle is constant and preferably between 3° and 15°.

Figure 3:
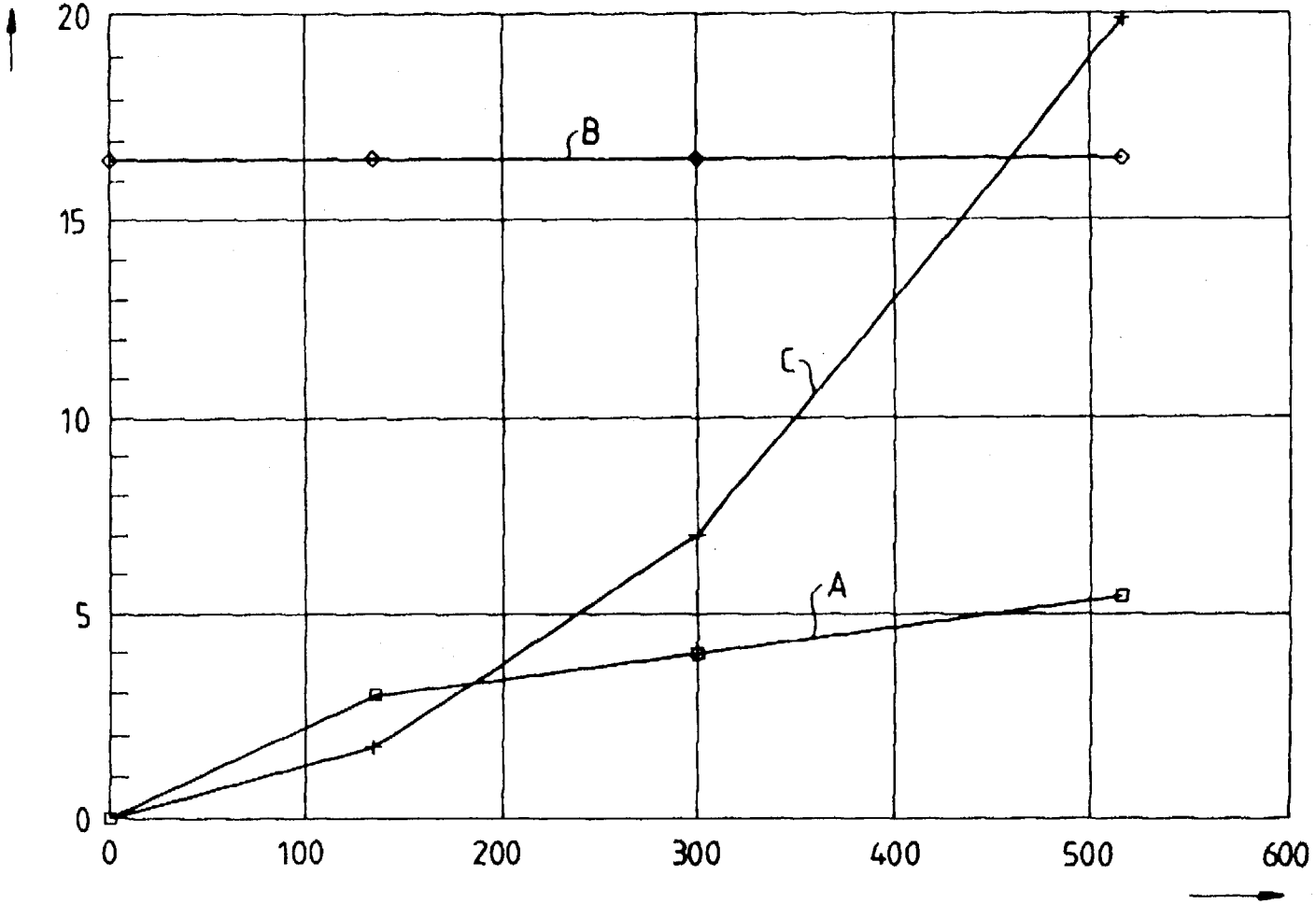
FIG. 3 is a graph representing the wear of the ductor blade as a function of time.

The graphical representation in FIG. 3 illustrates the wear on the blade 1 as a function of the service life or duration of operation. The ceramic coating 5 of the blade 1 optimally matches the contour of the ink duct roller 6 immediately after being placed in operation, so that no machining or other processing is required, as was necessary heretofore, on an installation which simulates the effects of the bearing forces exerted by the adjustment elements acting upon the lower face of the blade, a few millimeters from the front edge thereof. Wear is extremely low throughout service, as curve A shows. It is clearly apparent that the blade can remain in service for a very long time yet. Even after 500 hours of use, wear on the ceramic is modest. By way of comparison, the curve C represents the wear on a blade of the prior art as a function of service life. It is clearly apparent that this heretofore known blade suffers much greater wear than that of the ductor blade 1 of the invention of the instant application, even after a short service life. The line B represents the amount of wear, i.e., the worn condition of the blade according to the prior state of the art.

I claim:

1. Doctor blade for an offset rotary printing press having an inking unit with an ink duct, comprising:

a ceramic coating disposed on an edge portion of the blade at a region thereof at which an ink duct roller is in contact therewith; and the blade having a free end and being formed with lateral edges converging towards said free end of the blade.

2. Doctor blade according to claim 1, wherein said ceramic coating contains titanium dioxide ($TiO_2$).

3. Doctor blade according to claim 1, wherein said ceramic coating contains alumina ($Al_2O3$).

4. Doctor blade according to claim 1, wherein said ceramic coating comprises a mixture of alumina ($Al_2O3$) and a small percentage of titanium dioxide (TiO2).

5. Doctor blade according to claim 1, wherein said ceramic coating has a bending flexibility.

6. Doctor blade according to claim 1, wherein said ceramic coating is deposited on of a nickel/chromium layer.

7. Doctor blade according to claim 1, wherein said contact region forms an angle a of 3° to 15° with a tangent to the inking roller passing through a line of contact.

8. Doctor blade according to claim 1, wherein said contact region is shaped as a chamfer of said free end of the blade.

9. Doctor blade according to claim 1, wherein the blade extends over almost the entire length of an ink plate of the ink duct roller.

10. Doctor blade according to claim 1, wherein the blade has a base body formed of steel including quenched steel.

11. Doctor blade according to claim 10, wherein said steel base body has two unmachined faces to which the ceramic coating is applied.

12. Doctor blade according to claim 1, wherein the blade has a base body formed of steel including a subsequently tempered steel.

* * * * *